US011505422B2

(12) United States Patent
Yamada et al.

(10) Patent No.: US 11,505,422 B2
(45) Date of Patent: Nov. 22, 2022

(54) PAPER SHEET HANDLING APPARATUS

(71) Applicant: FUJITSU FRONTECH LIMITED, Tokyo (JP)

(72) Inventors: Akira Yamada, Tokyo (JP); Tsuyoshi Abe, Tokyo (JP); Tetsuya Odaka, Tokyo (JP); Tatsuya Shimamura, Tokyo (JP); Takashi Wada, Tokyo (JP); Ryoka Niikuni, Tokyo (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 25 days.

(21) Appl. No.: 17/018,263

(22) Filed: Sep. 11, 2020

(65) Prior Publication Data

US 2020/0407186 A1 Dec. 31, 2020

Related U.S. Application Data

(63) Continuation of application No. PCT/JP2018/011160, filed on Mar. 20, 2018.

(51) Int. Cl.
*B65H 31/24* (2006.01)

(52) U.S. Cl.
CPC ..... *B65H 31/24* (2013.01); *B65H 2701/1912* (2013.01)

(58) Field of Classification Search
CPC combination set(s) only.
See application file for complete search history.

(56) References Cited

U.S. PATENT DOCUMENTS

2005/0040225 A1* 2/2005 Csulits ..... G07D 11/20 235/379
2015/0047539 A1 2/2015 Togiya
2018/0165907 A1 6/2018 Yang

FOREIGN PATENT DOCUMENTS

CN 103168318 A 6/2013
CN 103168318 B * 9/2015 ..... G07D 11/40
(Continued)

OTHER PUBLICATIONS

Extended European Search Report, dated Dec. 3, 2021, in corresponding European Application No. 18910515.8 (8 pp.).
(Continued)

*Primary Examiner* — Jennifer Bahls
(74) *Attorney, Agent, or Firm* — Staas & Halsey LLP

(57) ABSTRACT

A paper sheet handling apparatus includes a handling section and a plurality of housing units. The handling section includes an upstream conveyance mechanism and a validation section. The upstream conveyance mechanism conveys paper sheets. The validation section validates paper sheets conveyed by the upstream conveyance mechanism. The housing units each include a downstream conveyance mechanism and a housing section. The downstream conveyance mechanism conveys paper sheets conveyed from the handling section. The housing section houses therein paper sheets conveyed by the downstream conveyance mechanism. Each of the housing units can be coupled to another one thereof via the downstream conveyance mechanisms, and a group of the downstream conveyance mechanisms, which are coupled together, is coupled to a group of the housing sections in a manner that allows the group of the downstream conveyance mechanisms to integrally pivot with respect to the group of the housing sections.

5 Claims, 7 Drawing Sheets

(56) References Cited

FOREIGN PATENT DOCUMENTS

| | | | | | |
|---|---|---|---|---|---|
| CN | 107481410 | | | 12/2017 | |
| EP | 2128831 | A1 | * | 12/2009 | ..... G07D 11/40 |
| JP | 09235061 | A | | 9/1997 | |
| JP | 2005353103 | A | | 12/2005 | |
| JP | 2012238137 | A | | 12/2012 | |
| JP | 2014102593 | A | * | 6/2014 | ..... G06F 16/40 |
| JP | 2014102593 | A | | 6/2014 | |
| JP | 2018014002 | A | | 1/2018 | |
| TW | I607416 | B | | 12/2017 | |

OTHER PUBLICATIONS

Office Action, dated Sep. 2, 2021, in corresponding Chinese Patent Application No. 201880091296.9 (20 pp.).
International Search Report, dated Jun. 26, 2018, in International Application No. PCT/JP2018/011160 (9 pp.).

* cited by examiner

PAPER SHEET HANDLING APPARATUS

CROSS-REFERENCE TO RELATED APPLICATION

This application is a continuation application of International Application PCT/JP2018/011160, filed on Mar. 20, 2018 and designating the U.S., the entire contents of which are incorporated herein by reference.

FIELD

The present invention relates to a paper sheet handling apparatus.

BACKGROUND

As a banknote handling apparatus such as an automated teller machine (ATM), an apparatus including a housing device that houses deposited banknotes, is known. A banknote handling apparatus of this type includes, for example, a plurality of housing devices in accordance with the amount of banknotes to be handled, and the housing devices are coupled together via a conveyance mechanism that conveys banknotes.

Patent Literature 1: Japanese Patent Publication Laid-open No. 2012-238137

In the banknote handling apparatus described above, the number of needed housing devices changes depending on factors such as the environment of the handling of banknotes, and the number of housing devices therefore tends to subject to change as desired. For example, when a new housing device is added in the banknote handling apparatus, work needed for changing the number of housing devices, is complicated in a configuration that makes it unavoidable to extend a conveyance path of the conveyance mechanism and connect the conveyance mechanism to the new housing device. Against this inconvenience, simplification and speed-up of work for changing the number of housing devices is enabled by configuring each housing device as a housing unit that includes a housing section and a conveyance mechanism and coupling the housing units together via the conveyance mechanisms.

When maintenance is performed on conveyance paths that are coupled between the adjacent housing units, however, the maintainability of the conveyance mechanisms of the individual coupled housing units, is lowered as a result of the maintenance work that is performed with a conveyance path of the individual conveyance mechanism opened and closed with respect to each housing unit.

SUMMARY

According to an aspect of the embodiments, a paper sheet handling apparatus includes: a handling section including an upstream conveyance mechanism and a validation section, the upstream conveyance mechanism that conveys paper sheets, the validation section that validates paper sheets, which are conveyed by the upstream conveyance mechanism; and a plurality of housing units each including a downstream conveyance mechanism and a housing section, the downstream conveyance mechanism that conveys paper sheets conveyed from the handling section, the housing section that houses paper sheets, which are conveyed by the downstream conveyance mechanism, wherein each of the housing units is capable of being coupled to another one of the housing units via the downstream conveyance mechanisms, and a group of the downstream conveyance mechanisms, which are coupled together, is coupled to a group of the housing sections in a manner that allows the group of the downstream conveyance mechanisms to integrally pivot with respect to the group of the housing sections.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

An embodiment of a paper sheet handling apparatus that is disclosed by the present application, is described below in detail based on the drawings. The embodiment described below is not intended to limit the paper sheet handling apparatus that is disclosed by the present application.

Embodiment (Configuration of Banknote Handling Apparatus)

Figure 1:
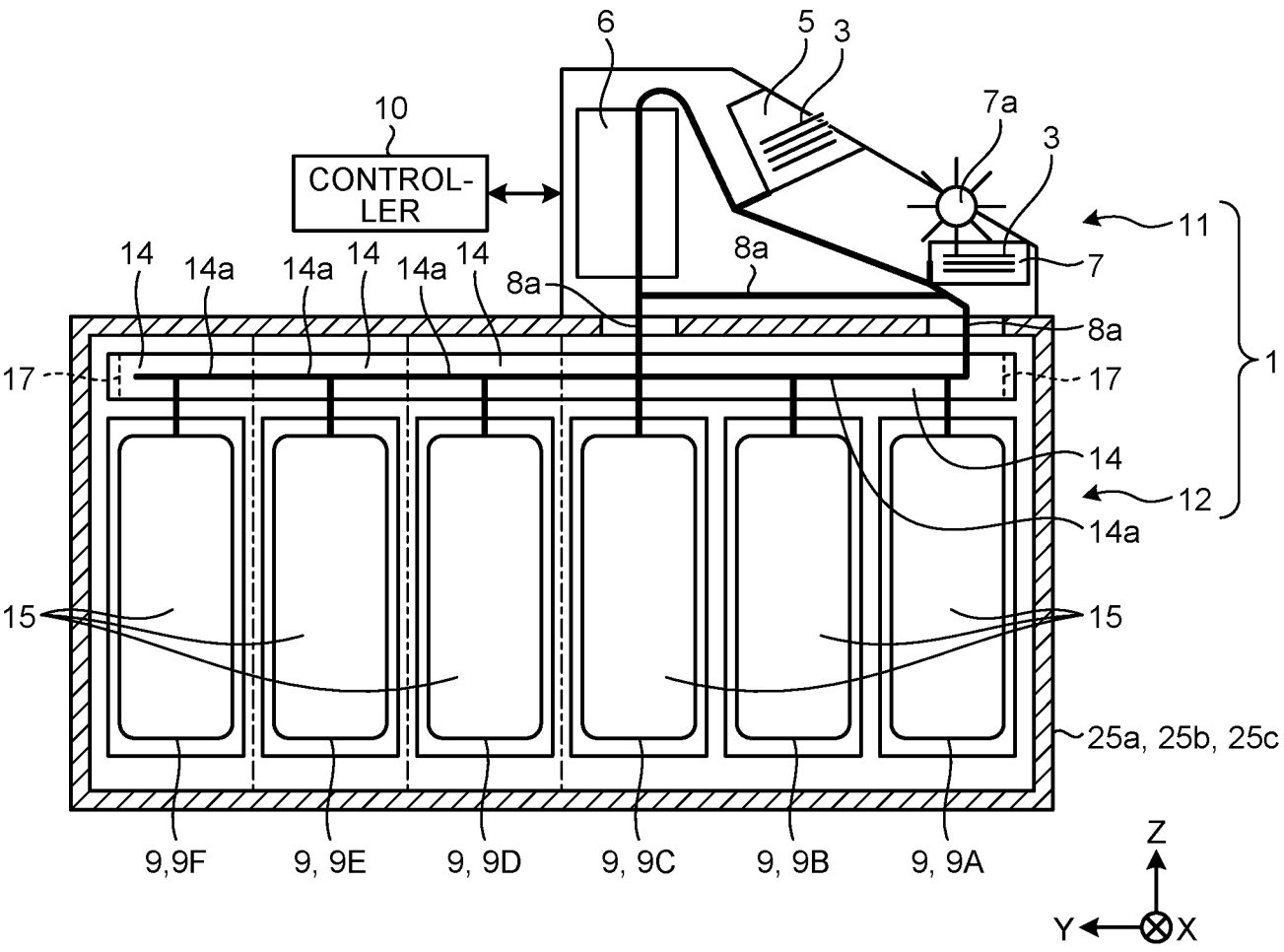
FIG. 1 is a schematic view illustrating a banknote handling apparatus according to an embodiment.

FIG. 1 is a schematic view illustrating the banknote handling apparatus according to the embodiment. As illustrated in FIG. 1, banknote handling apparatus 1 according to the embodiment includes: a depositing section 5 through which a user deposits banknotes 3; a validation section 6 that validates banknotes 3, which are conveyed from the depositing section 5; a dispensing section 7 that dispenses banknotes 3 to users; and an upstream conveyance mechanism 8 including conveyance paths 8*a* that convey banknotes 3 among the depositing section 5, the validation section 6, and the dispensing section 7. The dispensing section 7 has an impeller 7*a* provided thereto that feeds out banknotes 3. The banknote handling apparatus 1 further includes a plurality of housing units 9 that houses banknotes 3, which are delivered from the validation section 6.

The banknote handling apparatus 1 according to the present embodiment may include, as appropriate, a temporary housing section (not illustrated) that temporarily houses banknotes 3, which are deposited through the depositing section 5. The depositing section 5 and the dispensing section 7 may be configured as a single depositing and dispensing section (not illustrated). Any one of the housing units may be used as, for example, a backflow unit that houses banknotes 3 and delivers banknotes 3 to the dispensing section 7 or a collection unit that collects banknotes 3 that are abnormal and banknotes 3 that are deteriorated (damaged).

Of the banknote handling apparatus 1 according to the embodiment, a constituent part, in which the depositing section 5, the validation section 6, the dispensing section 7, and the upstream conveyance mechanism 8 are disposed, is configured as an upper device 11, and a constituent part, in which the housing units 9 are disposed, is configured as a lower device 12. The upper device 11 in the embodiment corresponds to a handling section according to the present application. The upper device 11 and each of housing units 9 in the lower device 12 are controlled by a controller 10. The upper device 11 and the lower device 12 are coupled together via two of the conveyance paths 8*a*, which are included in the upstream conveyance mechanism 8.

For convenience of explanation, with respect to the banknote handling apparatus 1, viewed from one side thereof, having the depositing section 5 in FIG. 1, a width direction of the banknote handling apparatus 1, is defined as an X-direction, a forward or backward direction of the banknote handling apparatus 1, is defined as a Y-direction, and an upward or downward direction of the banknote handling apparatus 1, is defined as a Z-direction. The drawings that follow FIG. 1 are also illustrated with the X-direction, the Y-direction, and the Z-direction that are defined in the same manner as in FIG. 1. While banknotes 3 are used as an example of the paper sheets in the present embodiment, the paper sheets are not limited to banknotes 3. Examples of the paper sheets include securities such as bills, checks, gift certificates, securities of various types, and share certificates.

(Configuration of Storage Unit)

Figure 2:
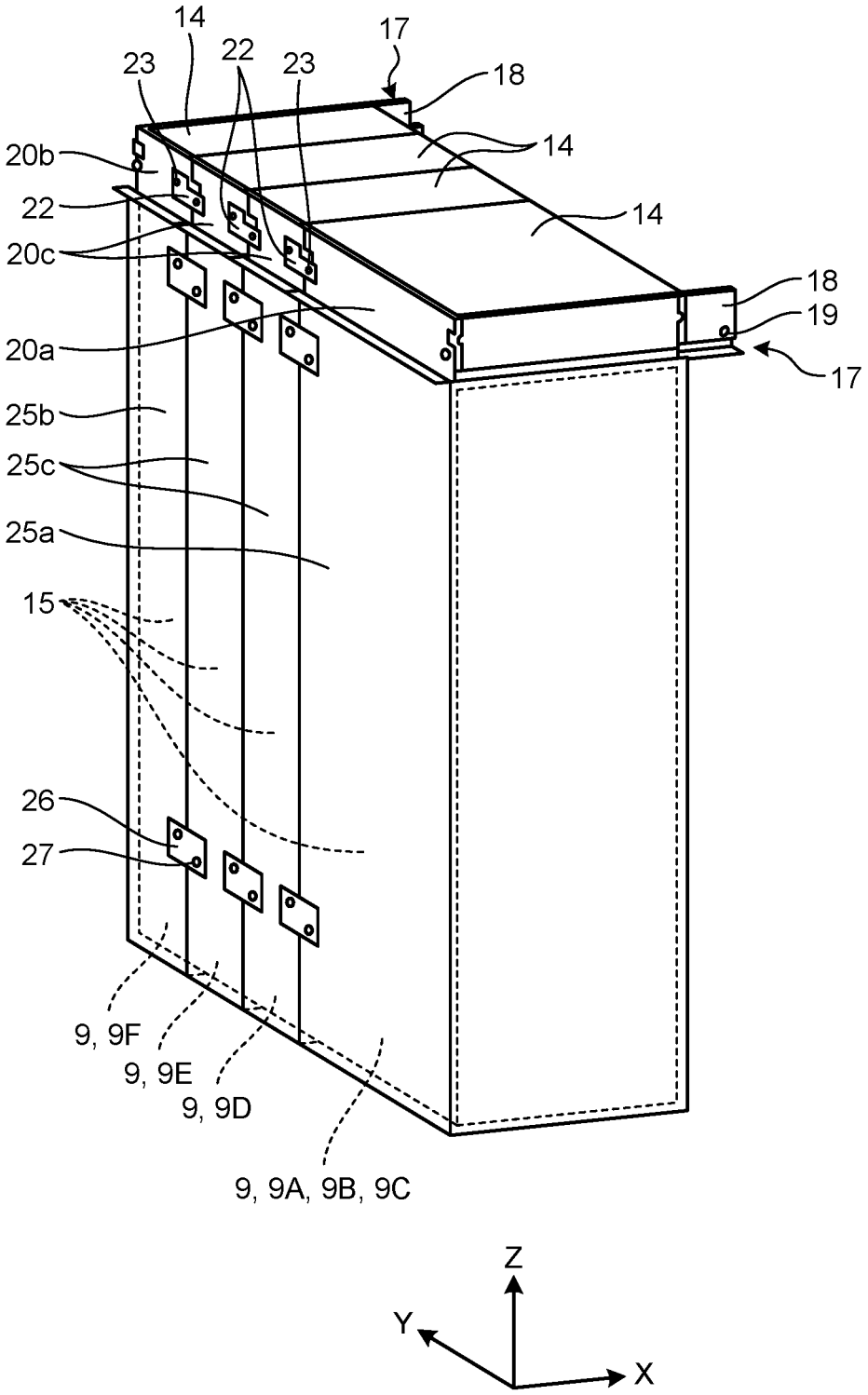
FIG. 2 is a perspective view illustrating housing units that are included in the banknote handling apparatus in the embodiment.
Figure 3:
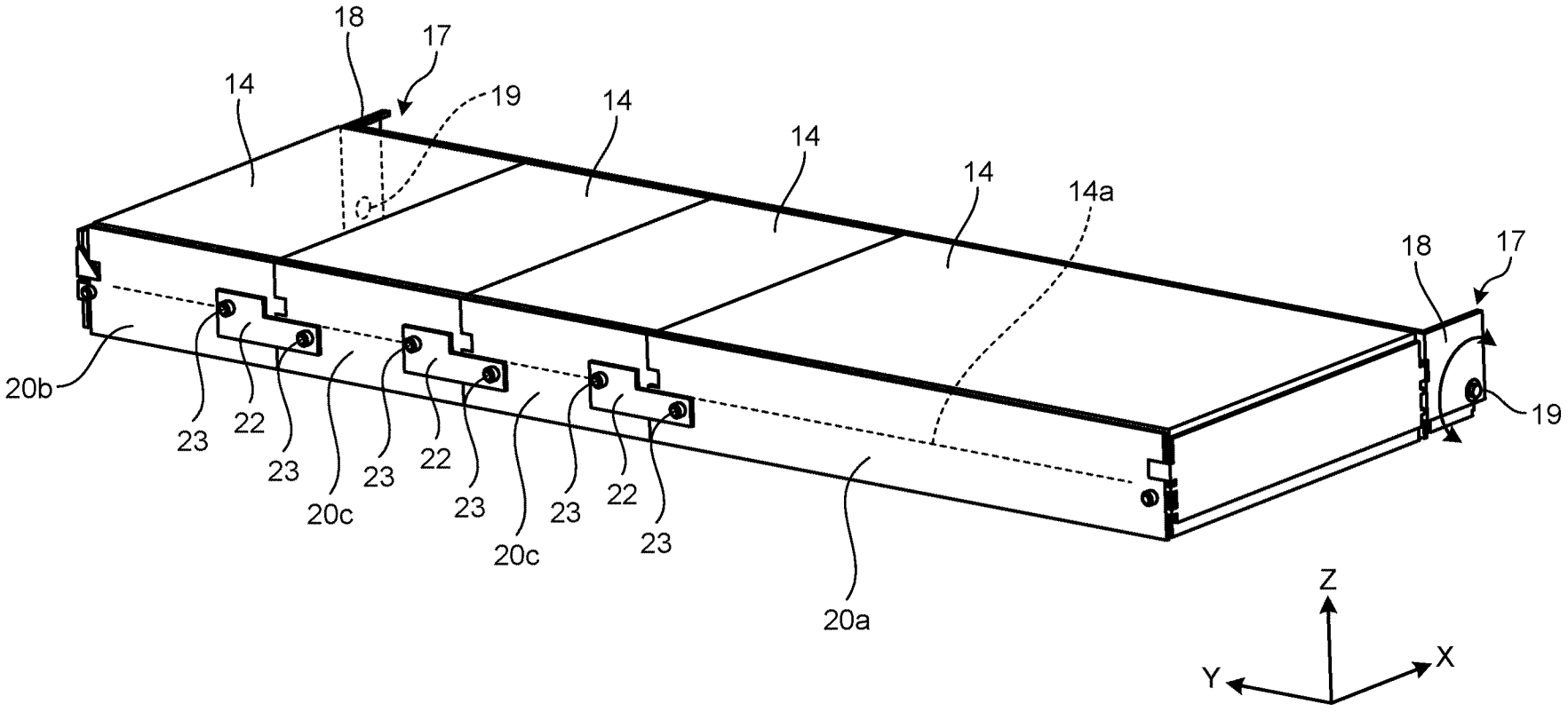
FIG. 3 is a perspective view illustrating downstream conveyance mechanisms in the housing unit in the embodiment.

FIG. 2 is a perspective view illustrating the housing units 9 that are included in the banknote handling apparatus 1 in the embodiment. FIG. 3 is a perspective view illustrating downstream conveyance mechanisms in the housing units 9 in the embodiment. As illustrated in FIG. 1, FIG. 2, and FIG. 3, each of the housing units 9 include: a downstream conveyance mechanism 14 that conveys banknotes 3, which are conveyed from the upper device 11; and a housing section 15 configured to house banknotes 3, which are conveyed by the downstream conveyance mechanisms 14.

The individual housing units 9 are provided in such a manner that the downstream conveyance mechanisms 14 can be separated from the housing section 15. Each of the downstream conveyance mechanism 14 includes a conveyance path 14*a* that conveys banknotes 3, and the conveyance path 14*a* is provided with a gate member (not illustrated) that switches between paths, which convey banknotes 3. The controller 10 described above causes the gate member to switch therebetween, thereby controlling a path for banknotes 3 between a path, through which banknotes 3 are housed by a corresponding one of the housing sections 15 (a path through which banknotes 3 are delivered from the corresponding housing section 15), and a path, through which banknotes 3 are delivered to the conveyance path 14*a* in the downstream conveyance mechanism 14 that is provided in the next housing unit 9.

In the banknote handling apparatus 1 given as an example, six housing units 9 (9A to 9F) are coupled together according to the present embodiment as illustrated in FIG. 1. Among those six housing units 9, the three housing units 9A, 9B, and 9C disposed in the starting-end side (upstream side in the conveyance direction of a group of the downstream conveyance mechanisms 14) in the coupling direction of the housing units 9 (9A to 9F) (the Y-direction), are the housing units 9 that are previously included as a factory-default standard specification for the banknote handling apparatus 1. Among the six housing units 9 (9A to 9F) in the banknote handling apparatus 1, the housing unit 9F disposed in the terminal-end side (the most downstream side in the conveyance direction of a group of the downstream conveyance mechanisms 14) in the coupling direction of the housing units 9 (9A to 9F), is the housing unit 9 that is previously included as a factory-default standard specification for the banknote handling apparatus 1.

In contrast, among the six housing units 9 (9A to 9F) in the banknote handling apparatus 1, the two housing units 9D and 9E coupled together between the housing unit 9C and the housing unit 9F, are the housing units 9 that are optionally added (housing units 9 that are additionally installed). Accordingly, for another one of the housing units 9 to be added, the new housing unit 9 is disposed and coupled between the housing unit 9C and the housing unit 9F, for example, between the housing unit 9F and the housing unit 9E (see FIG. 5). For the number of the housing units 9 to be reduced, any one of the two housing units 9D and 9E disposed between the housing unit 9C and the housing unit 9F, is removed, or, the two housing units 9D and 9E are removed, and the housing unit 9C and the housing unit 9F are then coupled together.

The above configuration is merely an example, and is not intended to limit the number of housing units 9 included in the banknote handling apparatus 1 as standard specifications. The banknote handling apparatus 1 may include only two of the housing units 9 as a standard specification, the two being the housing unit 9 disposed at the starting end in the coupling direction (the Y-direction) of the housing units 9, and the housing unit 9 disposed at the terminal end in the coupling direction.

As illustrated in FIG. 2 and FIG. 3, the housing units 9 are configured so that each of the housing units 9 can be coupled to another one thereof via the downstream conveyance mechanisms 14 along the coupling direction (the Y-direction) of the housing units 9. The banknote handling apparatus 1 according to the embodiment includes a coupling frame 20*a* and a coupling frame 20*b*. The coupling frame 20*a* couples together the downstream conveyance mechanisms 14 in the housing units 9A to 9C that are included as a standard specification. The coupling frame 20*b* is fixed to the downstream conveyance mechanism 14 in the housing unit 9F that is disposed at the terminal end in the coupling direction. The housing units 9D and 9E are provided with corresponding coupling frames 20*c* that are coupled to the downstream conveyance mechanisms 14 in the housing units 9, which are next to each other.

Each of the housing units 9A and 9F, which is disposed at both ends in the coupling direction of the housing units 9 (the Y-direction), includes a rotational support mechanism 17 that pivotably supports a group of the downstream conveyance mechanisms 14, which are coupled together, with respect to the group of the housing sections 15. The rotational support mechanism 17 includes a support frame 18, which is fixed to the corresponding downstream conveyance mechanism 14, and a rotational shaft 19, which is pivotably supported by the support frame 18. The rotational support mechanisms 17 are fixed to the coupling frames 20*a* and 20*b*. The group of the downstream conveyance mechanisms 14 is rotated about the rotational shafts 19 with respect to the group of the housing sections 15.

In other words, the housing units 9B to 9E that are other than the housing units 9A and 9F, which are disposed at both ends in the coupling direction (the Y-direction), do not include the rotational support mechanisms 17 that allow the downstream conveyance mechanisms 14 to pivot with respect to the housing sections 15. Thus eliminating the rotational support mechanisms 17, results in a simplified configuration.

The axial direction of the rotational shaft 19 that is included in the rotational support mechanism 17, is disposed along the coupling direction of the group of the downstream conveyance mechanisms 14 (the Y-direction). Increase in the size of a space occupied by the downstream conveyance mechanisms 14 in an unfolded state when being made to pivot with respect to the group of the housing sections 15, due to change in the number of the housing units 9, can be thus suppressed.

As illustrated in FIG. 2 and FIG. 3, the coupling frames 20*a*, 20*b*, and 20*c* are coupled together via coupling members 22 and fastening members 23 such as screws, whereby the individual downstream conveyance mechanisms 14 in the housing units 9, are positioned in alignment with one another, and coupled in the coupling direction (the Y-direction). Accordingly, the group of the downstream conveyance mechanisms 14, which are connected together, is coupled to the group of the housing sections 15 via the rotational support mechanisms 17 of the housing units 9A and 9F at both ends in the coupling direction in a manner that allows the group of the downstream conveyance mechanisms 14 to integrally pivot.

Figure 7:
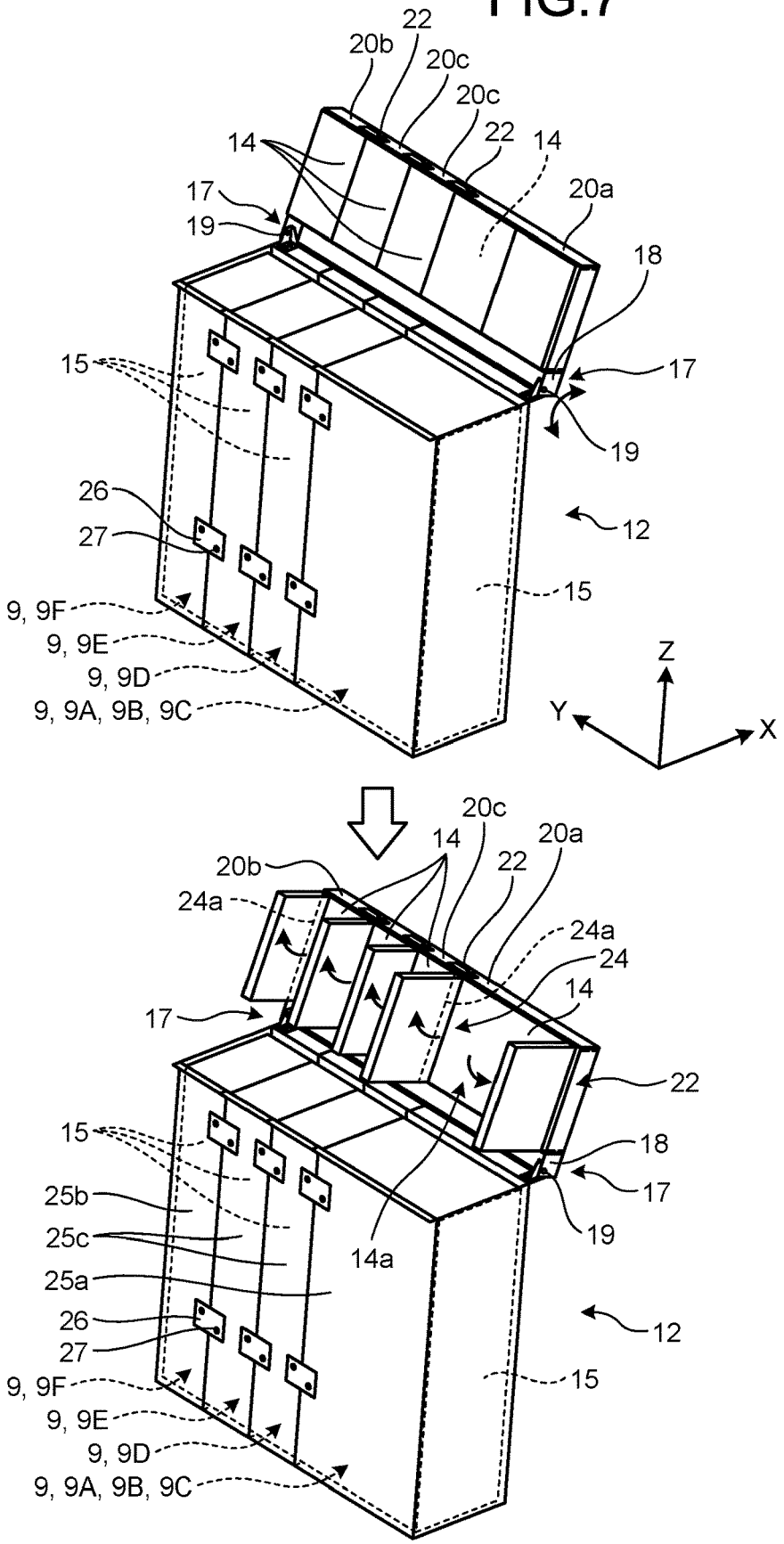
FIG. 7 is a perspective view for explaining operation of unfolding the downstream conveyance mechanisms in the housing units in the embodiment.

The downstream conveyance mechanisms 14 in the individual housing units 9, include opening/closing mechanisms 24 that split the downstream conveyance mechanisms 14 along the conveyance paths 14*a* (see FIG. 7). The opening/closing mechanism 24 includes a rotational shaft 24*a* that extends in a direction (the X-direction) perpendicular to the coupling direction of the group of the downstream conveyance mechanisms 14 (the Y-direction). In the group of the downstream conveyance mechanisms 14, the conveyance paths 14*a* are split and opened by allowing lower parts of the conveyance paths 14*a* to pivot about the rotational shafts 24*a*.

Figure 4:
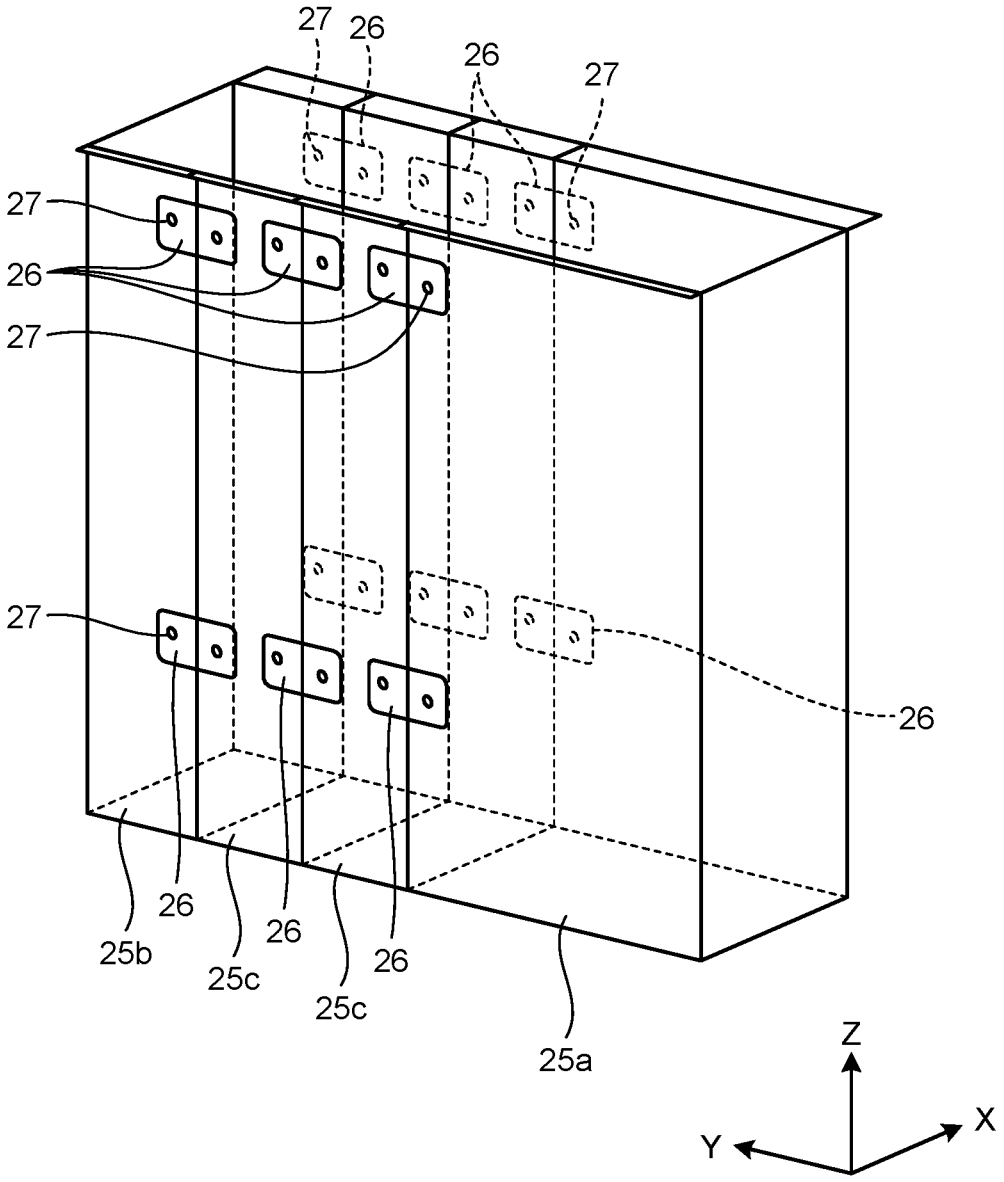
FIG. 4 is a perspective view illustrating casings of the housing units in the embodiment.

FIG. 4 is a perspective view illustrating casings of the housing units 9 in the embodiment. The individual housing units 9 (9A to 9F) are provided with casings 25*a*, 25*b*, and 25*c* that are provided to the outer sides of the housing sections 15 as illustrated in FIG. 1 and FIG. 4. The individual housing units 9A to 9C included in the banknote handling apparatus 1 as a standard specification, are provided with the casing 25*a*, which is integrally formed. The housing unit 9F, which is disposed at the terminal end in the coupling direction of the housing units 9 (the Y-direction), is provided with the casing 25*b*, which is formed so as to cover the terminal-end side of the conveyance paths 14*a*. The housing units 9D and 9E are provided with the corresponding casings 25*c* each coupled to the housing unit 9 that is adjacent thereto.

The casings 25*a*, 25*b*, and 25*c* of the housing units 9 (9A to 9F) are coupled together via coupling members 26 and fastening members 27 such as screws, thereby collectively forming a box-like shape, and are configured as a part of an outer casing of the lower device 12. With the housing units 9 thus coupled together via the casings 25*a*, 25*b*, and 25*c*, the coupling of the group of the downstream conveyance mechanisms 14 is enhanced in stability.

(Coupling of Downstream Conveyance Mechanisms in Housing Units)

Figure 5:
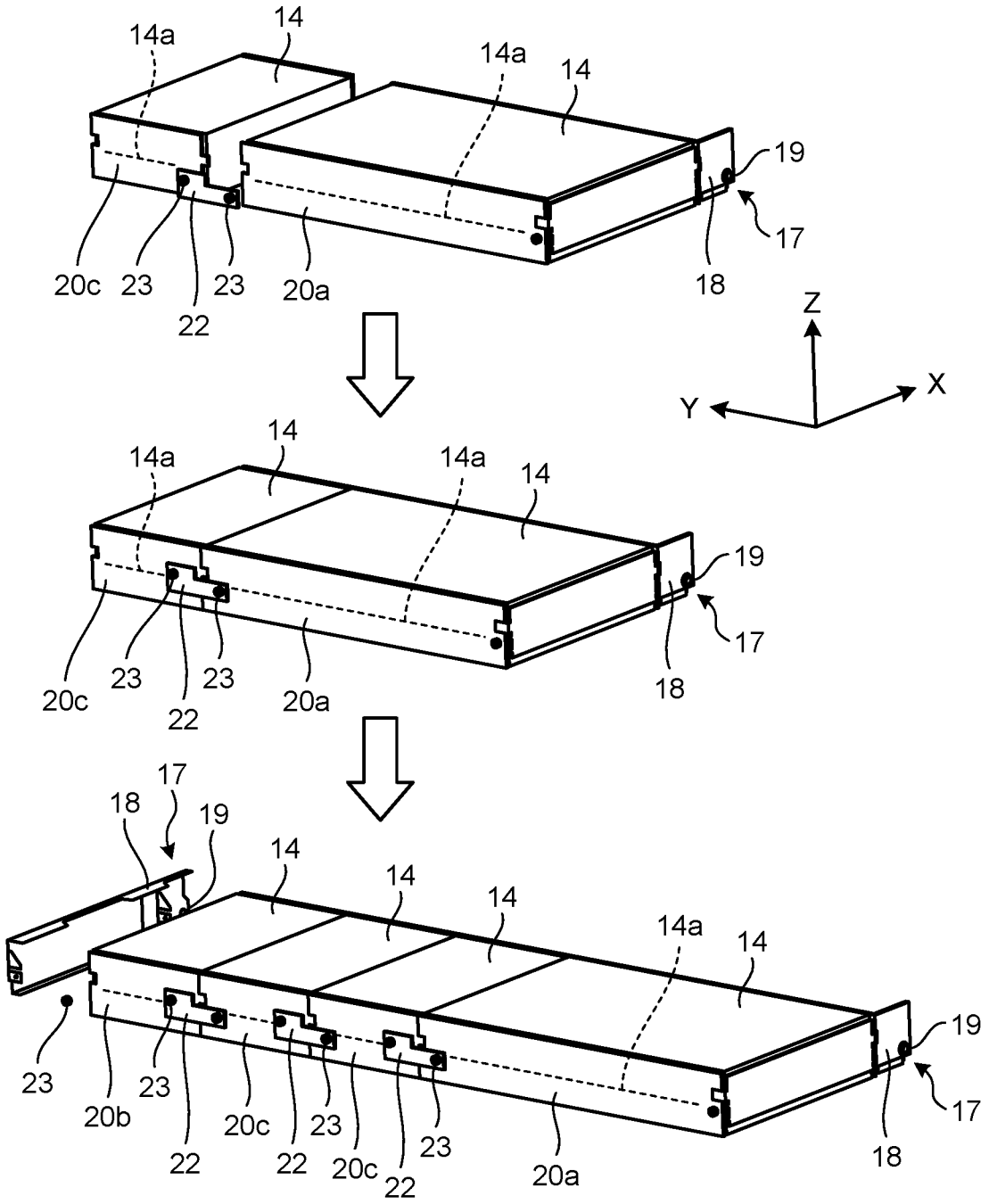
FIG. 5 is a perspective view for explaining coupling of the downstream conveyance mechanisms in the housing units in the embodiment.

FIG. 5 is a perspective view for explaining coupling of the downstream conveyance mechanisms 14 in the housing units 9 in the embodiment. As illustrated in FIG. 5, when the housing units 9 (9A to 9F) are connected together in the coupling direction (the Y-direction), the group of the individual downstream conveyance mechanisms 14 is coupled together.

First, the coupling frame 20*c* of the downstream conveyance mechanism 14 in the housing unit 9D is positioned in alignment with the coupling frame 20*a* of the downstream conveyance mechanisms 14 in the housing units 9A to 9C, and fixed thereto via the coupling member 22 and the fastening member 23. Through the same procedure as above, the coupling frames 20*c* of the downstream conveyance mechanisms 14 in the housing units 9D and 9E are positioned in alignment with each other and fixed to each other via the coupling member 22 and the fastening member 23. Finally, the coupling frame 20*b* of the downstream conveyance mechanism 14 in the housing unit 9F, which is disposed at the terminal end, is positioned in alignment with the coupling frame 20*c* of the downstream conveyance mechanism 14 in the housing unit 9E, and fixed thereto via the coupling member 22 and the fastening member 23. The rotational support mechanism 17 is fixed to the downstream conveyance mechanism 14 of the housing unit 9F via the support frame 18. The downstream conveyance mechanisms 14 in the individual housing units 9 are thus coupled together while being positioned in alignment with one another, thereby being integrally pivotable about the rotational shafts 19 of the rotational support mechanisms 17.

(Coupling of Housing Sections in Housing Units)

Figure 6:
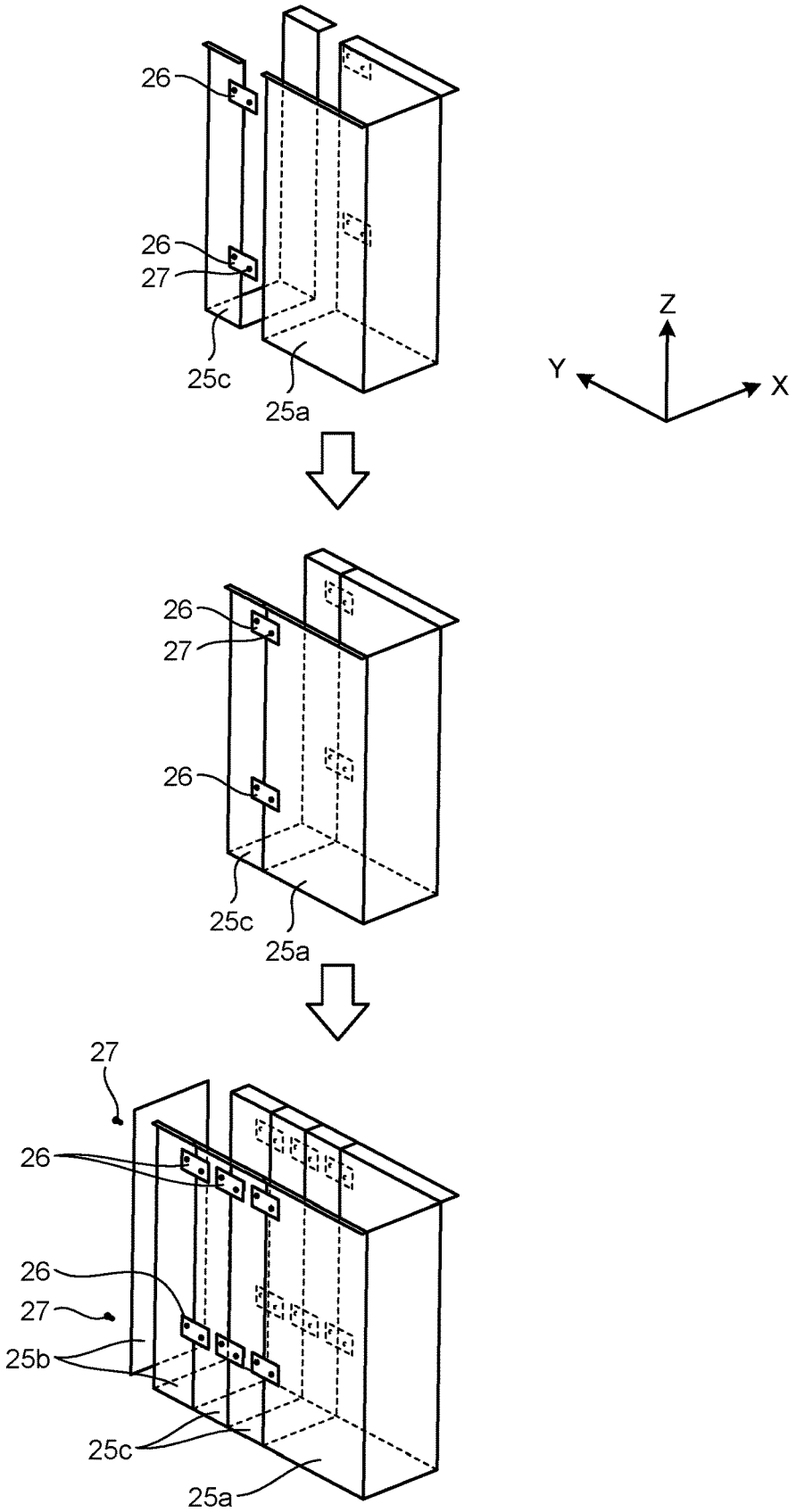
FIG. 6 is a perspective view for explaining coupling of the housing sections in the housing units in the embodiment.

FIG. 6 is a perspective view for explaining coupling of the housing sections 15 in the housing units 9 in the embodiment. FIG. 6 omits illustration of the housing sections 15 for the sake of convenience. As illustrated in FIG. 6, the individual housing sections 15 in the housing units 9 (9A to 9F) are coupled together via the casings 25*a*, 25*b*, and 25*c*.

First, the casing 25*c* of the housing unit 9D is positioned in alignment with the casing 25*a* of the housing units 9A to 9C, and fixed thereto via the coupling members 26 and the fastening members 27. Through the same procedure as above, the casings 25*c* of the housing units 9D and 9E are positioned in alignment with each other, and fixed to each other via the coupling members 26 and the fastening members 27. Finally, the casing 25*b* of the housing unit 9F is positioned in alignment with the casing 25*c* of the housing unit 9E, and fixed thereto via the coupling members 26 and the fastening members 27. With the individual housing sections 15 thus coupled together via the casings 25*a*, 25*b*, and 25*c*, the coupling of the individual housing units 9 is enhanced in stability.

(Operation of Unfolding Downstream Conveyance Mechanisms in Housing Units)

FIG. 7 is a perspective view for explaining operation of unfolding the downstream conveyance mechanisms 14 in the housing units 9 in the embodiment. As illustrated in FIG. 7, when maintenance is performed on the conveyance paths 14*a* in the downstream conveyance mechanisms 14, the group of the downstream conveyance mechanism 14 is integrally rotated about the rotational shafts 19 of the rotational support mechanisms 17 with the downstream conveyance mechanisms 14 kept being coupled together. The group of the downstream conveyance mechanisms 14 is thereby integrally separated from the group of the housing sections 15.

Subsequently, the conveyance paths 14*a* in the individual downstream conveyance mechanisms 14 in the group of the downstream conveyance mechanisms 14 that has been separated from the group of the housing sections 15 are individually opened via the opening/closing mechanisms 24, whereby maintenance is smoothly performed on the conveyance paths 14*a*. During this maintenance, the conveyance paths 14*a* are opened and closed about the rotational shafts 24*a* perpendicular to the coupling direction of the downstream conveyance mechanisms 14 (the Y-direction), whereby increase in the size of a space occupied by the conveyance paths 14*a* in an unfolded state when being opened or closed about the rotational shafts 24*a* can be suppressed.

As described above, in the banknote handling apparatus 1 according to the embodiment, each of the housing units 9, which includes the downstream conveyance mechanisms 14 and the housing sections 15, can be coupled to another one of the housing units 9 via the downstream conveyance mechanisms 14, and the group of the downstream conveyance mechanisms 14, which are coupled together, is coupled to the group of the housing sections 15 in a manner that allows the group of the downstream conveyance mechanisms 14 to integrally pivot. With the banknote handling apparatus 1, the housing units 9 are coupled together via the downstream conveyance mechanisms 14, whereby the number of housing units 9 can be easily changed. When maintenance is performed on the housing units 9, work of separating the downstream conveyance mechanisms 14 from the housing sections 15, is not needed to be performed with respect to each of the housing units 9. Instead, the group of the downstream conveyance mechanisms 14 can be collectively separated from the group of the housing sections 15, whereby maintenance is efficiently performed on the conveyance paths 14*a* in the group of the downstream conveyance mechanisms 14. Therefore, with the banknote handling apparatus 1, the number of housing units 9 can be easily changed, and the maintainability of the downstream conveyance mechanism 14 in each of the housing units 9, can be enhanced.

In the banknote handling apparatus 1 according to the embodiment, the housing units 9A and 9F, which are disposed at both ends among the housing units 9 (9A to 9F) in the coupling direction of the group of the downstream conveyance mechanisms 14 (the Y-direction), include the rotational support mechanisms 17 that pivotably support the downstream conveyance mechanisms 14 with respect to the housing sections 15. The group of the individual downstream conveyance mechanisms 14 in the housing units 9, is coupled together so as to be integrally pivotable via the rotational support mechanisms 17. Only the housing units 9A and 9F at both ends in the coupling direction of the housing units 9 (9A to 9F) thus, include the rotational support mechanisms 17, whereby the rotational support mechanisms 17 can be eliminated from the individual housing units 9B to 9E, which are disposed between the housing units 9A and 9F at both ends, and the configurations of the housing units 9E and 9F optionally added, can be simplified.

The rotational support mechanisms 17 in the housing units 9A and 9F, which are included in the banknote handling apparatus 1 according to the embodiment, include the rotational shafts 19, which are disposed along the coupling direction of the group of the downstream conveyance mechanisms 14 (the Y-direction). Increase in the size of a space occupied by the group of the downstream conveyance mechanisms 14 in an unfolded state, due to change in the number of the housing units 9 coupled together, can be thus suppressed.

In the banknote handling apparatus 1 according to the embodiment, the downstream conveyance mechanisms 14 in the individual housing units 9 (9A to 9F) include the opening/closing mechanisms 24 that split the downstream conveyance mechanisms 14 along the conveyance paths 14*a*, and the opening/closing mechanisms 24 include the rotational shafts 24*a*, which extend in the direction (the X-direction) perpendicular to the coupling direction of the group of the downstream conveyance mechanisms 14 (the Y-direction). Thus, the rotational shaft 19 that allows the group of the downstream conveyance mechanisms 14 to integrally pivot and the rotational shaft 24*a* of the opening/closing mechanisms 24 are disposed perpendicular to each other. Therefore, the individual conveyance paths 14*a* in the group of the downstream conveyance mechanisms 14 can be opened and closed within a compact range from a state, in which the group of the downstream conveyance mechanisms 14 is unfolded by the rotational support mechanism 17. This can suppress increase in the size of a space occupied by the conveyance paths 14*a* in an unfolded state. As a result, the maintainability of the downstream conveyance mechanisms 14 in the housing units 9 can be enhanced.

The individual housing units 9 (9A to 9F), which are included in the banknote handling apparatus 1 according to the embodiment, include the downstream conveyance mechanisms 14, and the casings 25*a*, 25*b*, and 25*c*, which are provided on the outer sides of and the housing sections 15. The casings 25*a*, 25*b*, and 25*c* are coupled together. Thus, coupling of the housing units 9 is reinforced, and coupling of the housing units 9 can be enhanced in stability.

According to an aspect of the paper sheet handling apparatus that is disclosed by the present application, the number of housing units can be easily changed, and the maintainability of a conveyance mechanism in each housing unit can be enhanced.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet handling apparatus comprising:

a handling section including an upstream conveyance mechanism and a validation section, the upstream conveyance mechanism that conveys paper sheets, the validation section that validates paper sheets, which are conveyed by the upstream conveyance mechanism; and a plurality of housing units each including a downstream conveyance mechanism and a housing section, the downstream conveyance mechanism that conveys paper sheets conveyed from the handling section, the housing section that houses paper sheets, which are conveyed by the downstream conveyance mechanism, wherein each of the housing units is capable of being coupled to another one of the housing units via the downstream conveyance mechanisms, and a group of the downstream conveyance mechanisms, which are coupled together, is coupled to a group of the housing sections in a manner that allows the group of the downstream conveyance mechanisms to integrally pivot with respect to the group of the housing sections, wherein at least one of the housing units, which are disposed at a non-end portion among the plurality of housing units in a coupling direction of a group of the downstream conveyance mechanisms, is detachable.

2. The paper sheet handling apparatus according to claim 1, wherein each of the housing units, which are disposed at both ends among the housing units in a coupling direction of a group of the downstream conveyance mechanisms, includes a rotational support mechanism that pivotably supports the downstream conveyance mechanisms with respect to the housing sections, and a group of the individual downstream conveyance mechanisms in the housing units is coupled together so as to be integrally pivotable via the rotational support mechanisms.

3. The paper sheet handling apparatus according to claim 2, wherein the rotational support mechanism includes a rotational shaft that is disposed along a coupling direction of the group of the downstream conveyance mechanisms.

4. The paper sheet handling apparatus according to claim 1, wherein the housing units are individually provided with casings that are provided to outer sides of the housing sections, and the casings are coupled together.

5. A paper sheet handling apparatus comprising:

a handling section including an upstream conveyance mechanism and a validation section, the upstream conveyance mechanism that conveys paper sheets, the validation section that validates paper sheets, which are conveyed by the upstream conveyance mechanism; and a plurality of housing units each including a downstream conveyance mechanism and a housing section, the downstream conveyance mechanism that conveys paper sheets conveyed from the handling section, the housing section that houses paper sheets, which are conveyed by the downstream conveyance mechanism, each of the housing units disposed at both ends among the housing units in a coupling direction of a group of the downstream conveyance mechanisms comprising a rotational support mechanism that includes a rotational shaft disposed along a coupling direction of the group of the downstream conveyance mechanisms and that pivotably supports the downstream conveyance mechanisms with respect to the housing sections, wherein each of the housing units is capable of being coupled to another one of the housing units via the downstream conveyance mechanisms, and a group of the downstream conveyance mechanisms, which are coupled together, is coupled to a group of the housing sections in a manner that allows the group of the downstream conveyance mechanisms to integrally pivot with respect to the group of the housing sections, the downstream conveyance mechanism in each of the housing units includes an opening/closing mechanism that splits the downstream conveyance mechanism along a conveyance path, and the group of downstream conveyance mechanisms are coupled together so as to be integrally pivotable via the rotational support mechanisms, and the opening/closing mechanism includes a rotational shaft that extends in a direction perpendicular to the coupling direction of the group of the downstream conveyance mechanisms.

* * * * *